US005200114A

United States Patent [19]

Beck

[11] Patent Number: 5,200,114

[45] Date of Patent: Apr. 6, 1993

[54] ALKALINE CLEANER FOR REDUCING STAIN ON ALUMINUM SURFACES

[75] Inventor: Leslie M. Beck, Perkasie, Pa.

[73] Assignee: Man-Gill Chemical Company, Cleveland, Ohio

[21] Appl. No.: 791,488

[22] Filed: Nov. 12, 1991

Related U.S. Application Data

[62] Division of Ser. No. 573,650, Aug. 24, 1990, Pat. No. 5,110,494.

[51] Int. Cl.[5] ..... C11D 7/06; C11D 7/32; C11D 17/00; C11D 10/02

[52] U.S. Cl. ..... 252/542; 252/156; 252/174.17; 252/174.19

[58] Field of Search ..... 252/156, 542, 174.17, 252/174.19

[56] References Cited

U.S. PATENT DOCUMENTS

| | | | |
|---|---|---|---|
| 2,618,603 | 11/1952 | Schaeffer | 252/542 X |
| 2,618,608 | 11/1952 | Schaeffer | 106/14.12 X |
| 2,955,093 | 10/1960 | Solomon | 106/14.13 X |
| 3,819,529 | 6/1974 | Murphy | 252/156 |
| 4,202,796 | 5/1980 | Jacob et al. | 252/389 A |
| 4,251,384 | 2/1981 | Rooney | 252/147 |
| 4,341,878 | 7/1982 | Marcantonio et al. | 106/80 X |
| 4,351,883 | 9/1982 | Marcantonio et al. | 428/45 D |
| 4,409,121 | 10/1983 | Latos et al. | 252/389 A |
| 4,457,322 | 7/1984 | Rubin et al. | 252/135 X |
| 4,578,208 | 3/1986 | Geke et al. | 252/156 X |
| 4,599,116 | 7/1986 | King et al. | 252/156 X |
| 4,696,763 | 9/1987 | Bentley et al. | 252/391 |
| 4,859,351 | 8/1989 | Awad | 252/32.5 |
| 4,992,212 | 2/1991 | Corring et al. | 252/542 |

FOREIGN PATENT DOCUMENTS

| | | | |
|---|---|---|---|
| 0132765 | 2/1985 | European Pat. Off. . | |
| 0282921 | 9/1988 | European Pat. Off. . | |
| 0286265 | 10/1988 | European Pat. Off. | 252/542 |
| 60-260699 | 12/1985 | Japan . | |
| 1062173 | 3/1967 | United Kingdom . | |

OTHER PUBLICATIONS

PCT International Search Report for PCT/US91/06038.

Mobay Corporation, Product Information for VULKANOX MB-2/MGC, Feb. 1989.

PMC Specialties, Inc., Material Safety Data Sheet for Coleratec TT-35-A (Aug. 22, 1985).

PMC Specialties Group, Inc., Technical Bulletin 3100 for COBRATEC 99.

PMC Specialties Group, Inc. Technical Bulletin 3230 for COBRATEC CBT.

R. T. Vanderbilt Company, Specificatrion for VANOX MTI, Mar. 7, 1988.

R. T. Vanderbilt Company, Technical Data Sheet for NACAP.

*Chemical Abstracts*, 1985, 103:202685h.

*Primary Examiner*—W. J. Shine
*Assistant Examiner*—Douglas J. McGinty
*Attorney, Agent, or Firm*—Renner, Otto, Boisselle & Sklar

[57] ABSTRACT

An aqueous alkaline cleaner and a process are described for reducing the discoloration of aluminum surfaces treated with are aqueous alkaline cleaner compositions. The process comprises including in the aqueous cleaner composition, an effective amount of at least one heterocyclic compound. Enhanced mobility of the aluminum surfaces also can be obtained when the heterocyclic compound is a solid particulate compound which is mixed with an oil prior to addition to the aqueous alkaline cleaner. In a preferred embodiment, the heterocyclic compounds are soluble pyrroles, imidazoles, pyrazoles, thiazoles or triazoles.

7 Claims, No Drawings

ALKALINE CLEANER FOR REDUCING STAIN ON ALUMINUM SURFACES

This is a divisional of copending application Ser. No. 07/573,650 filed on Aug. 24, 1990, now U.S. Pat. No. 5,110,494.

FIELD OF THE INVENTION

The present invention relates to an alkaline cleaner and a process for inhibiting surface discoloration on alkaline cleaned aluminum surfaces. More particularly, the invention relates to a process for inhibiting the formation of stains and improving the mobility of formed aluminum surfaces such as aluminum containers.

BACKGROUND OF THE INVENTION

When metal surfaces, particularly aluminum surfaces, are exposed to hot aqueous solutions for extended periods of time, there is a tendency for such surfaces to develop a stain which may range to a brown or black. Discoloration of the aluminum surfaces becomes a problem in certain industries, particularly in the food industry. For example, alcoholic beverages are pasteurized in metal containers by subjecting the cans to hot water baths or sprays in the range of from about 110° F. to 170° F. When the metal containers are subjected to hot water, there is a tendency with the metal surface, particularly in aluminum surface, to stain upon exposure to the atmosphere. One technique which has been utilized to prevent tarnishing is the application of a conversion coating to metal containers. Chromates and phosphates have been utilized in the industry as conversion coatings for inhibiting corrosion.

In the manufacture of aluminum cans, the cans have been washed with acidic cleaners to remove aluminum fines and other contaminants. Concern regarding the residue remaining on the cans following acidic cleaning (e.g., fluoride) has resulted in the evaluation of alkaline cleaning procedures for removing such fines and contaminants. However, the aluminum cans which have been cleaned with alkaline cleaning solutions are still subject to discoloration such as by the formation of brown stains. Furthermore, darker stains often result from linestops, which occur frequently in high-speed container washers. These stains are aesthetically unacceptable and may result in the rejection or scrapping of the final product, thereby increasing manufacturing costs.

A clean and stain-free aluminum surface also is desirable in order to insure the proper application of paints and inks. It is also desirable that the aluminum cans can be conveyed through printers at high speed. The term "mobility" is used in the industry to refer to the ability of an aluminum container to travel smoothly through the manufacturing process conducted at the highest speed possible. Improved mobility allows for increases in production and increased profits. If the containers are not characterized by an acceptable mobility, the flow of cans through the printers is affected and often results in frequent jammings, down time, printer misfeeding problems, loss of production and high rate of can rejects.

U.S. Pat. Nos. 4,341,878 and 4,351,883 describe compositions and processes for treating aluminum surfaces for tarnish and corrosion resistance. The process involves contacting the aluminum surfaces with an aqueous solution containing a mixture of an alkali metal silicate and an organic polymer having displaceable hydrogens or displaced hydrogen. Typical of the organic polymers disclosed in these patents are polyacrylates, polyvinyl alcohols, polystyrene sulfonic acid, etc.

U.S. Pat. No. 4,457,322 describes alkaline cleaning compositions for aluminum surfaces which are non-corrosive and which avoid discoloration or tarnishing of aluminum surfaces. The compositions comprise a mixture of an alkali metal metasilicate and a compound selected from sodium carbonate, potassium carbonate, lithium carbonate, potassium orthophosphate and sodium orthophosphate. The compositions may also include surfactants selected from nonionic, anionic, amphoteric or zwitterionic detergents.

U.S. Pat. No. 4,599,116 describes an alkaline cleaning process for aluminum container surfaces. The aqueous alkaline cleaning composition contains an alkalinity agent, a complexing agent to dissolve at least some of the metal ions removed from the metal surface by the cleaning solution, and at least one surfactant to remove organic soils from the surfaces of the container and to inhibit white-etch staining of the surfaces. Examples of complexing agents include gluconic acid, citric acid, tartaric acid, sodium tripolyphosphate, etc.

U.S. Pat. No. 4,859,351 describes a lubricant and surface conditioner for formed metal surfaces such as aluminum cans. The composition is stated to reduce the coefficient of static friction on the outside surface of the cans which permits a substantial increase in production line speed. The lubricant and surface conditioners disclosed in this patent are selected from water-soluble organic phosphate esters; alcohols; fatty acids including mono-, di-, tri-, and poly-acids; fatty acid derivatives such as salts, hydroxy acids, amides, esters, ethers and derivatives thereof; and mixtures thereof. The lubricant and surface conditioner may be applied to the cans during the wash cycle, during one of the treatment cycles, or after the final water rinse.

SUMMARY OF THE INVENTION

An aqueous alkaline cleaner and a process are described for reducing the discoloration of aluminum surfaces treated with aqueous alkaline cleaner compositions. The process comprises including in the aqueous cleaner composition, an effective amount of at least one heterocyclic compound. Enhanced mobility of formed aluminum also can be obtained when the heterocyclic compound is a solid particulate compound which is mixed with an oil prior to addition to the aqueous alkaline cleaner. In a preferred embodiment, the heterocyclic compounds are pyrroles, imidazoles, pyrazoles, thiazoles or triazoles.

DESCRIPTION OF THE PREFERRED EMBODIMENTS

The aqueous alkaline cleaner compositions of the present invention comprise at least one inorganic base, at least one soluble, dispersable or emulsifiable heterocyclic compound, and water. Generally and preferably, the cleaner composition also contains at least one metal complexing agent. In a preferred embodiment, the cleaner composition also contains at least one surfactant.

In one embodiment, the aqueous alkaline cleaner compositions of the invention are concentrates which may be diluted with water to form solutions, dispersions or emulsions useful for cleaning aluminum surfaces. The concentrates generally will comprise from about 20 to about 75% by weight of an inorganic base or mixture of inorganic bases, about 1 to about 15% by weight of the metal complexing agent, about 1 to about 20% by weight of the heterocyclic compound and about 10 to about 70 parts by weight of water. These concentrates may also contain other additives normally used in alkaline cleaning solutions such as surfactants, anti-foam agents, etc.

When diluted with water to form the aqueous alkaline cleaner compositions of the present invention which can be used for cleaning of aluminum surfaces, the diluted solutions will contain from about 100 to about 5000 parts of the heterocyclic compound per million parts of solution. The diluted solutions are often referred to as operative or working solutions. In one preferred embodiment, the working aqueous alkaline cleaner solutions will contain from about 100 to about 3000 ppm. of the heterocylic compound. The amount of base contained in the working aqueous alkaline cleaning solution should be an amount sufficient to provide a solution having a pH which is effective for removing aluminum fines and soil from the metal surface. The pH of the working solution should be at least about 10 with an upper limit of about 13. Preferably, the pH of the working aqueous alkaline cleaning solutions of the present invention is within the range of from about 11.5 to about 12.5.

The inorganic base utilized in the alkaline cleaner solutions of the present invention may comprise any one of a combination of bath-soluble and compatible compounds including alkali or alkaline earth metal borates, carbonates, hydroxides, phosphates, silicates, and mixtures thereof. The alkali metal hydroxides and carbonates generally are preferred materials. The type and amount of base utilized in the aqueous alkaline cleaner solutions of the present invention are selected to provide operating baths which are effective to remove substantially all of the aluminum fines on the container surfaces while at the same time not unduly etching the aluminum surface thereby resulting in a clean, bright, reflective appearance.

In accordance with the present invention, improved results are obtained with alkaline cleaner compositions containing at least one soluble heterocyclic compound. The heterocyclic compounds contain one or more atoms such as oxygen, sulfur or nitrogen in addition to carbon. The heterocyclic compounds are either soluble, dispersable or emulsifiable in water. In one preferred embodiment, the heterocyclic compounds are water-soluble. In one preferred embodiment, the heterocyclic compounds are nitrogen-containing heterocyclic compounds which can be either unsaturated or saturated nitrogen-containing heterocyclic compounds, and the unsaturated nitrogen-containing heterocyclic compounds are particularly preferred.

The nitrogen-containing heterocyclic compounds which are useful in the present invention include heterocyclic compounds containing one, two or three nitrogen atoms, and nitrogen-containing heterocyclic compounds containing oxygen or sulfur in addition to nitrogen also may be utilized. Examples of unsaturated nitrogen-containing 5-membered heterocyclic compounds include pyrroles, imidazoles, pyrazoles, thiazoles and triazoles which may be substituted or unsubstituted. As illustrated more fully below, bicyclic heterocyclic compounds such as benzimidazoles, benzotriazoles and benzimidizoles also are contemplated as being included in the above terms.

The pyrroles which are useful in the present invention include pyrrole and pyrrole derivatives such as represented by the Formulae IA and IB.

(IA)

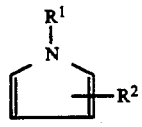

(IB)

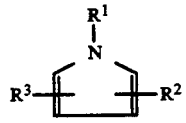

wherein $R^1$ is hydrogen or an alkyl group and $R^2$ and $R^3$ are each independently hydrogen or an alkyl, aryl, SX or COOX group wherein X is hydrogen or an alkali metal. Specific examples of such pyrroles include 1H pyrrole, 2H pyrrole, pyrrole-2-carboxaldehyde, pyrrole-2-carboxylic acid; 1-methyl pyrrole, 1-methyl pyrrole-2-carboxylic acid; benzopyrrole; 6-methyl-benzopyrrole, etc.

The imidazoles which are useful in the invention generally can be represented by Formulae IIA and IIB.

(IIA)

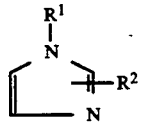

(IIB)

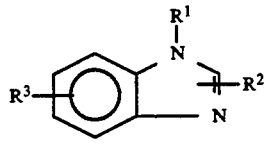

wherein $R^1$ is hydrogen, or an alkyl, acyl or vinyl group and $R^2$ and $R^3$ are each independently hydrogen or an alkyl, aryl, SX or COOX group wherein X is hydrogen or an alkali metal. Examples of such imidazoles include: imidazole; 1-vinyl imidazole; 1,2-dimethyl imidazole; 4-phenyl imidazole; 1-methyl imidazole; 1-ethyl imidazole; 2-methyl imidazole; 2-isopropyl imidazole; benzimidazole; 2-methyl benzimidazole; 2-mercepto benzimidazole; 2-methyl benzimidazole; 2-mercapto benzimidazole; 2-mercapto-4-methyl benzimidazole; and 2-mercapto-5-methyl benzimidazole.

The pyrazole compounds which are useful in the invention may be represented by the general Formulae IIIA and IIIB (IIIA)

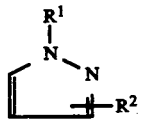

(IIIB)

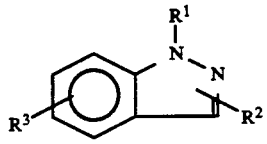

wherein $R^1$ is hydrogen or an alkyl group and $R^2$ and $R^3$ are each independently hydrogen or an alkyl, aryl, SX or COOX group. Examples of such pyrazole compounds include: pyrazole; 3-methyl pyrazole; 3,5-pyrazole dicarboxylic acid; benzopyrazole; etc.

The thiazole compounds which are useful in the present invention may be represented by Formula IVA and IVB (IVA)

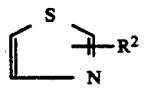

(IVB)

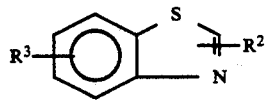

wherein $R^2$ and $R^3$ are each independently hydrogen or alkyl, aryl, SX or COOX groups wherein X is hydrogen or an alkali metal. Specific examples of such thiazole compounds include: thiazole; 2-amino-4-methylthiazole; 2,4-dimethyl thiazole; 2-amino-benzothiazole; 6-amino-benzothiazole; 2-methyl-benzothiazole; 2-phenyl-benzothiazole; 2-mercaptobenzothiazole; etc.

The triazoles useful in the present invention may be represented by the general Formulae VA, VB or VC (VA)

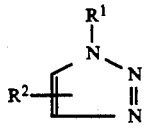

(VB)

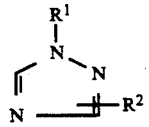

(VC)

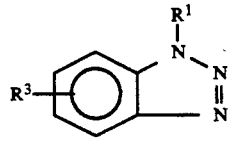

wherein $R^1$ is hydrogen or an alkyl group wherein X is hydrogen or an alkali metal; and $R^2$ and $R^3$ are each independently hydrogen or an alkyl, aryl, SX or COOX group wherein X is hydrogen or an alkali metal. Specific examples of such triazoles include 1,2,3-triazole; 3-amino-5-mercapto-1,2,4-thiazole; 3-mercapto-1,2,4-triazole; benzotriazole; 1-methyl-benzotriazole; 5-methyl-benzotriazole; 5-ethyl-benzotriazole; etc.

Examples of other unsaturated nitrogen-containing heterocyclic compounds which may be included in the alkaline cleaner compositions of the present invention include six-membered heterocyclic compounds such as pyridines, pyrazines and triazines. Examples of saturated nitrogen-containing heterocyclic compounds which may be used include pyrrolidines, piperazines, piperidines and morpholines.

In addition to the inorganic base and the heterocyclic compound, the alkaline cleaner compositions utilized in the present invention preferably contain at least one metal complexing agent which is soluble in the alkaline cleaner composition and which is effective to complex at least some of the metal ions present in the operating bath to avoid the formation of deleterious precipitates. Among the various complexing agents which have been suggested as being useful in alkaline cleaner compositions are the sugar acids and salts thereof. Specific examples of complexing agents suitable for use in the alkaline cleaners of this invention include gluconic acid, citric acid, glucoheptanoic acid, sodium tripolyphosphate, EDTA, tartaric acid, etc., as well as the bath-soluble and compatible salts thereof such as the alkali metal salts thereof. The aqueous alkaline cleaner compositions (concentrates) of the present invention generally will contain from about 1 to about 15% by weight of the complexing agent. The concentration of the complexing agent in the operating or working bath is controlled within the range of from about 0.01 up to about 5 g/l.

The aqueous alkaline cleaner concentrate compositions in the present invention also may contain at least one surfactant. The operating or working solution generally and preferably contains at least one surfactant. More often, a combination of at least two surfactants are utilized in the operative aqueous alkaline cleaner compositions to effect an efficient removal of lubricants and organic soils of the types customarily employed in the drawing and forming of aluminum containers. Combinations of nonionic and anionic surfactants are particularly useful.

The nonionic surfactants may be those containing ether linkages and which are represented by the following general formula $$RO(R'O)_nH$$

wherein R is a hydrocarbon group containing from 6 to 30 carbon atoms, R' is an alkylene group containing 2 or 3 carbon atoms or mixtures thereof, and n is an integer of from 2 to 100. Such surfactants are produced generally by treating fatty alcohols or alkyl-substituted phenols with an excess of ethylene oxide or propylene oxide. The alkyl carbon chain may contain from about 14 to 24 carbon atoms and may be derived from a long chain fatty alcohol such as oleo alcohol or stearyl alcohol.

Nonionic polyoxyethylene surfactants of the type represented by the above formula are available commercially under the general trade designations "Surfynol" by Air Products Chemicals, Inc., "Pluronic" or "Tetronic" by BASF Corp., Chemical Division; "Tergitol" by Union Carbide; and "Surfonic" by Texaco Chemicals. Examples of specific polyoxyethylene condensation products useful in the aqueous alkaline cleaner compositions of the present invention include "Surfynol 465" which is a product obtained by reacting about 10 moles of ethylene oxide with one mole of tetramethyldecynediol. "Surfynol 485" is a product obtain by reacting 30 moles of ethylene oxide with tetramethyldecynediol. "Pluronic L35" is a product obtained by reacting 22 moles of ethylene oxide with propylene glycol; "Tergitol TMN 3" is an ethoxylated trimethylnonanol with an HLB of 8.3, and "Tergitol TMN 6" is an ethoxylated trimethylnonanol with an HLB of 11.7. "Surfonic N95" is an ethoxylated nonyl phenol with an HLB of 12.9 and "Pluronic L61" is a block copolymer of propylene oxide and ethylene with an HLB of from 1 to 7.

Another type of nonionic ethoxylated surfactant which is useful in the aqueous alkaline cleaner solutions used in the present invention are block copolymers of ethylene oxide and propylene oxide based on a glycol such as ethylene glycol or propylene glycol. The copolymers based on ethylene glycol generally are prepared by forming a hydrophilic base by reaction of ethylene oxide with ethylene glycol followed by condensation of this intermediate product with propylene oxide. The copolymers based on propylene glycol similarly are prepared by reacting propylene oxide with propylene glycol to form the intermediate compound which is then condensed with ethylene oxide. By varying the proportions of ethylene oxide and propylene oxide used to form the above copolymers, the properties may be varied. Both of the above types of copolymers are available commercially such as from BASF Chemicals under the general trademark "Pluronic". The condensates based on ethylene glycol are identified as the "R" series, and these compounds preferably contain from about 30 to about 80% of polyoxyethylene in the molecule and may be either liquids or solids. The condensates based on propylene glycol are identified generally by BASF as the "F", "L", or "P" series, and these may contain from about 5 to about 80% of ethylene oxide. The "L" series of propylene glycol based copolymers are liquids, the "F" series are solids, and the "P" series are pastes. The solids and pastes can be used when they are soluble in the aqueous cleaner solutions. The molecular weights of these block copolymers range from about 400 to about 14,000.

Anionic surfactants also may be included in the aqueous alkaline cleaner solutions used in the present invention.

In one embodiment, the anionic surfactants are sulfates or sulfonates. As examples of suitable anionic detergents there may be cited the higher alkyl mononuclear aromatic sulfonates such as the higher alkyl benzene sulfonates containing from 10 to 16 carbon atoms in the alkyl group and a straight or branched chain, e.g., the sodium salts of decyl, undecyl, dodecyl tridecyl, tetradecyl, pentadecyl or hexadecyl benzene sulfonate and the higher alkyl toluene, xylene and phenol sulfonates; alkyl naphthalene sulfonate, and sodium dinonyl naphthalene sulfonate.

Other anionic detergents are the olefin sulfonates, including long chain alkene sulfonates, long chain hydroxyalkane sulfonates or mixtures thereof. These olefin sulfonate detergents may be prepared, in known manner, by the reaction of $SO_3$ with long chain olefins having 8–25, preferably 12–21 carbon atoms. Examples of other sulfate or sulfonate detergents are paraffin sulfonates, such as the reaction products of alpha olefins and bisulfites (e.g., sodium bisulfite). These include primary paraffin sulfonates of about 10–20, preferably about 15–20 carbon atoms; sulfates of higher alcohols; and salts of α-sulfofatty ester (e.g., of about 10 to 20 carbon atoms, such as methyl α-sulfomyristate or α-sulfotallate).

Examples of sulfates of higher alcohols are sodium lauryl sulfate, sodium tallow alcohol sulfate, or sulfates of mono- or diglycerides of fatty aids (e.g., stearic monoglyceride monosulfate), alkyl poly(ethoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly(ethenoxy) ether sulfates such as the sulfates of the condensation products of ethylene oxide and nonyl phenol (usually having 1 to 20 oxyethylene groups per molecule preferably 2–12).

Of the various anionic detergents mentioned, the preferred salts are sodium salts and the higher alkyls are of 10 to 18 carbon atoms, preferably of 12 to 18 carbon atoms. Specific exemplifications of such compounds include: sodium linear tridecyl benzene sulfonate; sodium linear pentadecyl benzene sulfonate; sodium p-n-dodecyl benzene sulfonate; sodium lauryl sulfate; potassium coconut oil fatty acids monoglyceride sulfate; sodium dodecyl sulfonate; sodium nonyl phenoxy polyethoxyethanol (of 30 ethoxy groups per mole); sodium propylene tetramer benzene sulfonate; sodium hydroxy-n-pentadecyl sulfonate; sodium dodecenyl sulfonate; lauryl polyethoxyethanol sulfate (of 15 ethoxy groups per mole); and potassium methoxy-n-tetradecyl sulfate.

A series of sulfate and sulfonate anionic surfactants are available from the Henkel Corporation under the general trade designation "Sulfotex". For example, Sulfotex LAS-90 is reportedly a sodium dodecyl benzene sulfonate and Sulfotex LCX is a sodium lauryl sulfate.

The anionic surfactant may be of the phosphate mono- or diester type. These esters may be represented by the following formulae:

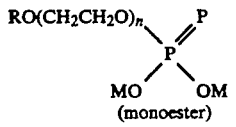

(monoester)

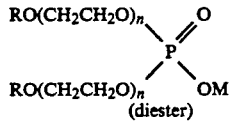

(diester)

wherein R is a fatty chain containing 10 to 18 carbon atoms; each n is independently an integer from 0 to 5; and M is any suitable cation such as alkali metal, ammonium and hydroxyalkyl ammonium.

These types of surfactants are also well known and are commercially available. One series is available from the GAF Corporation under the general trade designation "GAFAC". For example, GAFAC 510 and the G for "R" series are anionic surfactants reported to be free acids of a complex phosphate ester. Sodium and potassium salts of complex phosphate esters also are available under the GAFAC designation.

Anionic surfactants are also available from Rohm & Haas Company under the general trade designation "Triton". From example, Triton H-55 and H-66 are phosphate surfactants (potassium salts); Triton QS-30 and QS-44 are anionic phosphate surfactants in the free acid form; Triton W-30 is a sodium salt of an alkyl aryl polyether sulphate; and Triton DF-20 is a modified ethoxylate.

The amount of surfactant or combination of surfactants included in the aqueous alkaline cleaner compositions is an amount which is effective to remove contaminants from the surface of the container and to provide a substantially 100% water-break-free surface. A 100% water-break-free surface is achieved when the water "sheets off" leaving a continuous thin layer of water after rinsing. A 100% water-break-free surface represents a surface that is free of lubricants or oils. Typically, the amount of surfactant or combination of surfactants included in the operating or working aqueous alkaline cleaner will range from about 0.003 up to about 5 g/l with concentrations of from about 0.02 to about 1 g/l being preferred.

The operative cleaning compositions of this invention may be solutions, dispersions or emulsions depending on the types and amounts of the various components of the compositions. In one preferred embodiment, the cleaning compositions are solutions.

The working or operating compositions may be prepared by mixing the components in various sequences. In one embodiment, concentrates are prepared and thereafter blended with additional water. For example, a first concentrate containing at least one base, a metal complexing agent and the heterocyclic compound in water is prepared, and a second concentrate of the surfactants is also prepared. The two concentrates are then blended into additional water to form the operating solution. Alternatively, the first concentrate can be blended with additional water followed by the addition of one or more surfactants directly into the diluted concentrate.

The aqueous alkaline cleaner compositions of the present invention as concentrates and diluted operating solutions are illustrated by the following examples. Unless otherwise indicated in the examples and elsewhere in the specification and claims, all parts and percentages are by weight, temperatures are in degrees Fahrenheit, and pressures are at or near atmospheric pressure. If a temperature is not mentioned, it is presumed to be ambient temperature.

EXAMPLE A (Concentrate)

To a mixing vessel, add 10 parts of water at 120° F. Sodium gluconate (10 parts) is then added with stirring, and after the sodium gluconate is dissolved, 6.6 parts of a 45% aqueous potassium hydroxide solution and 73.4 parts of a 50% aqueous sodium hydroxide solution are added. The mixture is blended until uniform.

Example B (Concentrate)

The procedure of Example A is repeated except that the sodium gluconate is replaced by 10 parts of sodium tripolyphosphate.

EXAMPLE C (Operating Solution)

A surfactant mixture is prepared comprising 36 parts of Surfonic N-95, 24 parts of Pluronic L-61 and 40 parts of Triton H-55. To a vessel containing 4 liters of water, there is added 15 milliliters of the concentrate of Example A and 1.7 milliliters of the surfactant mixture, and the contents of the vessel are blended until uniform.

In accordance with the present invention, the aqueous alkaline cleaning composition (solution, dispersion or emulsion) is applied to the aluminum substrate at relatively low to moderate temperatures such as from about ambient temperature to about 150° F. More generally, the aqueous alkaline cleaner composition is applied to the substrate at temperatures within the range of from about 90° F. to about 130° F. Contact between the substrates to be cleaned and the cleaning composition can be effected by flooding, immersion or spraying. The start-up and make-up compositions can be prepared by employing a concentrate of the various constituents in the appropriate proportions. The concentrate can be provided in the form of a dry powder or preferably, in the form of an aqueous concentrate containing from about 50 to about 90% by weight of water with the balance comprising the active ingredients present in the same relative proportions as employed in the diluted aqueous alkaline cleaner solution.

In accordance with the preferred practice of the present invention, the aluminum surfaces (sheets or formed articles) are subjected to a prewash before being contact with the aqueous alkaline cleaner composition. The prewash is effective to remove a portion of the aluminum fines and soils from the container thereby reducing the buildup of such contaminants in the succeeding cleaning step. The prewash may comprise water and a dilute solution of the alkaline cleaner, or the prewash may comprise a dilute solution of an acid such as sulfuric acid. The prewash stage typically is operated within the range of temperatures employed in the alkaline cleaner stage although higher or lower temperatures can be used if desired.

Following contact with the aqueous alkaline cleaner composition of the present invention, the treated substrate is subjected to an aqueous acidic rinse. The pH of the acidic rinse solution may vary from about 2 to about 5 or 6. The acidic rinse then is generally followed by one or more water rinses including a final rinse with deionized water followed by drying such as in an oven.

The following examples illustrate the method of the invention. In Examples 1–7, drawn and ironed cans of aluminum alloy 3004 from a can manufacturer are used. The treatment sequence is as follows:

(1) prewash with spray of aqueous sulfuric acid solution at a pH of 3.0° at 120° F. for 30 seconds at 20 psi;

(2) aqueous alkaline spray with solution at a pH of 11.8 to 12.5 at a temperature of 120° F. at 20 psi for 2 minutes; period, the cans are resprayed for 6 seconds at 5 psi followed by second dwell period of 1 minute;

(3) acid rinse with an aqueous sulfuric acid solution at a pH of 3.0 at a temperature of 120° F. for 30 seconds at 20 psi;

(4) tap water rinse for 10 seconds;

(5) deionized water rinse for 10 seconds; and (6) oven dry.

The dwell period and respray in step (2) simulate typical linestops in commercial multiple stage washers.

EXAMPLES 1–7

In these examples, the aqueous alkaline cleaner solution of Example C is used. The nitrogen-containing heterocyclic compound and the amounts added to the above-described alkaline cleaner solution in these examples is shown in Table I.

In the control example, no heterocyclic compound is added to the alkaline cleaner bath. Identification of the various commercial heterocyclic compounds utilized in Examples 1–6 is as follows: Vulkanox MB-2/MGC is a blend of 4- and 5-methyl mercaptobenzimidazole coated with mineral oil which is available from Mobay Corporation. The oil content of this material is about 2%; Vanox MTI is available from the R. T. Vanderbilt Company and is identified as 2-mercaptotoluimidazole; Cobratec TT-35-A is available from PMC Specialties Group, Inc., Cincinnati, Ohio, and is identified as a tolyltriazole/triethanolamine solution containing 35% tolyltriazole and 35% triethanolamine; NACAP is available from the R. T. Vanderbilt Company and is identified as a 50% aqueous solution of sodium mercaptobenzothiazole; Cobratec 99 is available from PMC Specialties Group, Inc. and is identified as benzotriazole; Cobratec CBT is available from PMC Specialties Group, Inc. and is identified as a 50:50 mixture of 4-and 5-carboxy-1H-benzotriazole.

The aluminum containers treated in accordance with the procedures of these examples are evaluated for stain after oven drying. The stain rating system is as follows:

| Stain | Rating |
|---|---|
| no stain | 0 |
| light brown | 3 |
| brown | 5 |
| dark brown | 8 |
| black | 10 |

More than one rating number indicates the presence of several stain intensities. For example, a rating of 5–8 indicates the presence of stain intensities of brown and dark brown. The results of the stain testing for Examples 1–7 also is reported in Table I. The improvements which are obtained with the aqueous alkaline cleaner compositions of the present invention when compared to the identical composition (Control) not containing any heterocyclic compound are evident from the results reported in Table I.

TABLE I

| Example | Additive | Concentration (PPM) | Stain Rating |
|---|---|---|---|
| Control | none | — | 5–9 |
| 1-A | Vulkanox MB-2/MGC | 500 | 5 |
| 1-B | Vulkanox MB-2/MGC | 1000 | 2–3 |
| 2-A | Vanox MTI | 100 | 5–7 |
| 2-B | Vanox MTI | 1000 | 2–3 |
| 3-A | Cobratec TT-35-A | 1000 | 5–9 |
| 3-B | Cobratec TT-35-A | 2000 | 0 |
| 4-A | NACAP | 2000 | 5 |
| 4-B | NACAP | 3000 | 2–3 |
| 5-A | Cobratec 99 | 1000 | 5–8 |
| 5-B | Cobratec 99 | 2000 | 0 |
| 6 | Cobratec CBT | 100 | 5 |
| 7-A | Mercaptobenzothiazole | 100 | 3–5 |
| 7-B | Mercaptobenzothiazole | 500 | 1–2 |

EXAMPLE 8

Alloy 5182 H19 4"×12" can end stock aluminum coil panels are cleaned by spraying with Ridoline 411K (a commercial alkaline cleaner available from Betz Products, Trevose, Pa.) diluted with water to 2% by volume and containing 125 ppm. of Vanox MTI. The solution is sprayed on the panels at 140° F., 20 psi. for 30 seconds and allowed to remain in the spray cabinet for an additional 30 seconds before rinsing with tap water for 10 seconds. The rinsed panels are then dried with a hot air gun and evaluated. The treated panels are not stained and have a bright appearance. In contrast, when the procedure of this example is repeated except that the Vanox MTI is omitted from the aqueous alkaline solution, the treated panels are stained brown.

EXAMPLE 9

Alloy 3004 4"×12" can stock aluminum coil panels are sprayed with Ridoline 411K diluted to 2% by volume in water and containing 250 ppm. of Vanox MTI for 30 seconds at 140° F. and at 20 psi. The sprayed panels are allowed to remain in the spray cabinet for 5 minutes and resprayed with the alkaline cleaner containing the Vanox MTI at 140° C. and 5 psi. for 3 seconds. Following a fresh water rinse for 10 seconds, the treated panels are dried with a hot air gun. The treated panels are not stained and have a bright appearance. When the procedure is repeated except that the Vanox MTI is omitted from the alkaline cleaner, the treated panels are stained brown.

In another embodiment of the present invention, aluminum surfaces can be treated in a manner which results in a reduction of the coefficient of static friction (COSF) of the surfaces in addition to the reduction in the discoloration of the aluminum surfaces. A reduction in the coefficient of static friction generally results in an improvement in mobility of formed aluminum. Mobility refers to the ability of the aluminum container to travel smoothly through a high speed manufacturing process. At high speeds, the sliding and rolling ability of cans in contact with each other and with the equipment while moving through the various conveyorized transfer lines may be reduced thereby resulting in objectional jamming and line stoppage. Improved mobility allows for increases in production without additional capital investments in new equipment and plants because improved mobility results in a reduction in line stoppage and may allow can manufacturers to increase their line and printer speeds.

It has now been discovered that the coefficient of static friction of aluminum container surfaces can be reduced, and the mobility of the containers enhanced by incorporating a particulate additive into the aqueous alkaline cleaner compositions typically utilized on aluminum containers. The additive added to the aqueous alkaline cleaner comprises a mixture of solid particles of at least one heterocyclic compound and a small amount of an oil. Generally, the mixture will comprise any of the above-described nitrogen-containing heterocyclic compounds available in powder form and from about 1 to about 15% by weight of the oil based on the weight of the heterocyclic compound. In another embodiment, the mixture will comprise from about 5 to about 10% by weight of the oil based on the weight of the heterocyclic compound. The mixtures of the heterocyclic powders and oil can be prepared by techniques well known to those skilled in the art. An example of a commercially available mixture useful in the present invention is Vulcanox MB-2/MGC, described above as a blend of 4- and 5-methylmercaptobenzimidizole coated with mineral oil. The oil content is about 1–2%.

The oil used in the mixtures which are added to the aqueous alkaline cleaner composition may be natural oils or synthetic oils or mixtures thereof. Natural oils include animal oils and vegetable oils (e.g., castor oil, lard oil), liquid petroleum oils and hydrorefined, solvent-treated or acid-treated mineral oils of the paraffinic, naphthenic and mixed paraffinic-naphthenic types.

Synthetic oils which are useful include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)]; alkyl benzenes such as dodecyl benzenes, tetradecyl benzenes, dinonyl benzenes, etc.; polyphenyls such as biphenyls and terphenyls; and alkylated diphenyl ethers and alkylated diphenyl sulfides and the derivatives, analogs and homologs thereof. Alkylene oxide polymers and interpolymers and derivatives thereof where the terminal hydroxyl groups have been modified by esterification, etherification, etc., constitute another type of known synthetic lubricating oil useful in the present invention.

Another suitable class of synthetic oils comprises the esters of dicarboxylic acids (e.g., phthalic acid, succinic acid, alkyl succinic acids, maleic acid, azelaic acid, suberic acid, sebacic acid, fumaric acid, adipic acid, malonic acid and alkyl malonic acids) with a variety of alcohols (e.g., butyl alcohol, hexyl alcohol, dodecyl alcohol, 2-ethylhexyl alcohol, ethylene glycol, diethylene glycol monoether and propylene glycol). Specific examples of such esters include dibutyl adipate, di(2-ethylhexyl)sebacate, dioctyl sebacate, diisooctyl azelate, dioctylphthalate, etc.

Esters useful as synthetic oils also include those made from $C_5$ to $C_{12}$ monocarboxylic acids and polyols and polyol ethers such as neopentyl glycol, trimethylol propane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic oils. Examples include tetraethyl silicate, tetraisopropyl silicate, poly(methyl)siloxanes and poly(methylphenyl)siloxanes. Other synthetic oils include liquid esters of phosphorus-containing acids such as tricresylphosphate, trioctylphosphate, etc., may be utilized.

EXAMPLES 10–13

The basic alkaline cleaner solution utilized in these examples as the same as utilized in Examples 1–7. The mixture of heterocyclic compound and oil utilized in these examples, and the amount of the mixture included in the aqueous alkaline cleaner solution are shown in Table II.

TABLE II

| Example | Mixture: Heterocyclic | Mixture: Oil type | % Oil | Conc. of Heterocyclic in Alkaline Solution (ppm) |
|---|---|---|---|---|
| 10-A | Vulkanox MB-2/MGC | Mineral | 1–2 | 500 |
| 10-B | Vulkanox MB-2/MGC | Mineral | 1–2 | 1000 |
| 11-A | Vanox | Mineral | 1 | 500 |
| 11-B | Vanox | Mineral | 2 | 500 |
| 11-C | Vanox | Mineral | 5 | 500 |
| 12-A | Mercaptobenzothiazole | Mineral | 5 | 500 |
| 12-B | Mercaptobenzothiazole | Mineral | 5 | 500 |
| 13-A | Vanox | Sunthene 4240[a] | 5 | 500 |
| 13-B | Vanox | Sunthene 410[b] | 5 | 500 |
| 13-C | Vanox | Poly G[c] | 5 | 500 |

[a]A hydrotreated heavy naphthenic distillate from Sun Refining and Marketing Co.
[b]A hydrotreated heavy naphthenic distillate from Sun Refining and Marketing Co.
[c]WI-625 Polyalkylene glycol synthetic lubricant from Olin Chemicals.

The process for treating the aluminum containers is as follows:

(1) Prewash containers with spray of aqueous sulfuric acid solution at a pH of 3.0, 120° F. and 20 psi. for 30 seconds.

(2) Aqueous alkaline spray with solution of Example D at a pH of from 11.5 to 12.5, 120° F. and 20 psi. for 2 minutes.

(3) Acid rinse with an aqueous sulfuric acid solution at a pH of 3, 120° F. and 20 psi. for 30 seconds.

(4) Tap water rinse for 10 seconds.

(5) Deionized water rinse for 10 seconds.

(6) Oven dry.

The mobility of the treated aluminum containers is evaluated with the following test procedure and equipment. The equipment comprises a platform which is raised through an arc of 90° to form an incline plane. The general procedure is as follows:

(1) Remove three cans from an oven and allow the cans to cool for 3 minutes. During this time, mark one set of "looper lines" on each can.

(2) Place the cans on the platform with the "looper lines" pointing upwardly. The two base cans are placed with the open side to the right. The top can is placed with the open end to the left, approximately one inch from the open end of the bottom cans.

(3) Slowly elevate the platform (incline plane) until the top can slides and strikes the horizontal surface. Note the angle of incline.

(4) Rotate the top can 90° and repeat the process three more times.

(5) Rotate the bottom cans 180° and repeat cycle once again.

The completed procedure produces 8 data points. The test results are reported as (1) average incline (in degrees) and (2) the average of the tangent of the angle of incline which is expressed as the "coefficient of static friction" (COSF). The average values obtained with the aqueous alkaline cleaner compositions of Examples 10–13 and four controls are summarized in the following Table III. Control 1 utilizes the same aqueous alkaline cleaner but does not contain any heterocyclic compound. Control 2 utilizes same alkaline cleaner and 500 ppm Vanox but Vanox is not mixed with oil. Control 3 uses same alkaline cleaner and 500 ppm of MBT but MBT is not mixed with oil. Control 4 is similar to Control 2 but conducted at same time as Examples 13A–13C.

TABLE III

Mobility Test Results

| Aluminum Treated With Alkaline Cleaner of | Average Incline (°) | COSF |
|---|---|---|
| Control-1 | 51.8 | 1.27 |
| Example 10-A | 39.5 | 0.82 |
| Example 10-A (repeat) | 38 | 0.78 |
| Example 10-B | 35.3 | 0.71 |
| Control-2 | 48 | 1.11 |
| Example 11-A | 49 | 1.14 |
| Example 11-B | 44 | 0.96 |
| Example 11-C | 45 | 1.0 |
| Control-3 | 53.1 | 1.33 |
| Example 12-A | 50.5 | 1.21 |
| Example 12-B | 50.3 | 1.13 |
| Control 4 | 53.2 | 1.33 |
| Example 13-A | 49.9 | 1.18 |
| Example 13-B | 51.3 | 1.24 |
| Example 13-C | 50.8 | 1.23 |

As can be seen from the above results, aluminum cans cleaned with aqueous alkaline cleaner compositions to which has been added a mixture of a powdered nitrogen-containing heterocyclic compound and oil exhibit generally improved mobility and reduced coefficient or static friction when compared to aluminum cans cleaned with an alkaline cleaner composition containing the corresponding powdered nitrogen-containing heterocyclic compound without oil or with aqueous alkaline cleaning solutions containing no nitrogen-containing heterocyclic compound.

The process of the present invention is applicable to pure aluminum or alloys of aluminum which may contain minor amounts of metals such as magnesium, manganese, copper and silicon. Three common alloys used in the container industry are identified as aluminum alloys 3003, 3004 and 5182.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An aqueous alkaline composition having a pH in the range of from about 11.5 to about 12.5 useful for cleaning aluminum surfaces comprising from about 20 to about 75% by weight of at least one inorganic base; from about 1 to about 15% by weight of at least one metal complexing agent; from about 1 to about 20% by weight of at least one heterocyclic compound selected from the group consisting of a pyrrole, imidazole or pyrazole compound; and from about 10 to about 70% by weight of water.

2. The composition of claim 1 wherein the inorganic base is at least one alkali metal hydroxide.

3. The composition of claim 1 also containing at least one surfactant.

4. The composition of claim 1 wherein the heterocyclic compound is an imidazole.

5. The composition of claim 1 wherein the heterocyclic compound is benzimidazole or a substituted benzimidazole.

6. The composition of claim 1 wherein the metal complexing agent is at least one sugar acid or salts thereof.

7. The composition of claim 1 wherein the pH of the composition is from about 11.8 to about 12.5.

* * * * *